US011092931B2

(12) United States Patent
Rochat

(10) Patent No.: US 11,092,931 B2
(45) Date of Patent: Aug. 17, 2021

(54) MECHANICAL WATCH MOVEMENT COMPRISING A STRIKING MECHANISM

(71) Applicant: Montres Breguet S.A., L'Abbaye (CH)

(72) Inventor: Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 467 days.

(21) Appl. No.: 16/185,515

(22) Filed: Nov. 9, 2018

(65) Prior Publication Data

US 2019/0163135 A1 May 30, 2019

(30) Foreign Application Priority Data

Nov. 30, 2017 (EP) ..... 17204727

(51) Int. Cl.

| | |
|---|---|
| ***G04B 21/02*** | (2006.01) |
| ***G04B 13/02*** | (2006.01) |
| ***G04B 35/00*** | (2006.01) |
| ***G04B 23/02*** | (2006.01) |

(52) U.S. Cl.

CPC ..... *G04B 13/02* (2013.01); *G04B 21/022* (2013.01); *G04B 23/023* (2013.01); *G04B 35/00* (2013.01)

(58) Field of Classification Search

CPC ..... G04B 35/00; G04B 13/02; G04B 21/022; G04B 23/023

See application file for complete search history.

(56) References Cited

U.S. PATENT DOCUMENTS 567,510 A * 9/1896 Riche ..... G04B 35/00 368/106
2,322,257 A * 6/1943 Stuart ..... G04B 21/022 368/270

(Continued)

FOREIGN PATENT DOCUMENTS

| | | |
|---|---|---|
| CH | 604 237 | 8/1978 |
| CH | 703 615 A2 | 2/2012 |
| EP | 2 133 758 A1 | 12/2009 |

OTHER PUBLICATIONS

Combined Chinese Office Action and Search Report dated Jun. 30, 2020 in Patent Application No. 201811450974.4 (with English translation of Categories of Cited Documents), 6 pages.

(Continued)

*Primary Examiner* — Sean Kayes
(74) *Attorney, Agent, or Firm* — Oblon, McClelland, Maier & Neustadt, L.L.P.

(57) ABSTRACT

A mechanical watch movement includes a striking mechanism with a first cannon equipped with a first cannon pinion having at least one snail intended to cooperate with a sensor device of the striking mechanism. The watch also includes a second cannon equipped with a second cannon pinion and carrying the minute hand. The first cannon pinion engages with a going train of the movement and a minute wheel. The minute wheel engages with the first cannon pinion. A motion-work pinion engages with an hour wheel coaxial with the second cannon. The minute wheel is mounted on a lever arranged to pivot about a fixed point. An angular position of the lever may be adjusted by pivoting in such a way as to permit regulation of the position of the minute wheel with respect to the first cannon pinion and to the second cannon pinion.

11 Claims, 5 Drawing Sheets

(56) References Cited

U.S. PATENT DOCUMENTS

| | | | | |
|---|---|---|---|---|
| 7,293,911 | B2 * | 11/2007 | Bonvin | G04F 3/022 368/106 |
| 2007/0091727 | A1 * | 4/2007 | Bonvin | G04F 7/0847 368/107 |
| 2010/0002546 | A1 | 1/2010 | Rochat et al. | |
| 2012/0230164 | A1 * | 9/2012 | Goeller | G04B 23/12 368/267 |
| 2018/0120770 | A1 * | 5/2018 | Breuilh | G04B 19/268 |

OTHER PUBLICATIONS

European Search Report dated May 25, 2018 in European application 17204727.6, filed on Nov. 30, 2017 (with English Translation of Categories of Cited Documents).

* cited by examiner

MECHANICAL WATCH MOVEMENT COMPRISING A STRIKING MECHANISM

CROSS-REFERENCE TO RELATED APPLICATION

This application claims priority to European Patent Application No. 17204727.6 filed on Nov. 30, 2017, the entire disclosure of which is hereby incorporated herein by reference.

FIELD OF THE INVENTION

The invention relates to a mechanical watch movement comprising a striking mechanism, and more specifically a suchlike movement comprising a device for limiting the backlash in the minute train.

The invention further relates to a timepiece, more particularly a wristwatch having a striking mechanism including a suchlike movement.

BACKGROUND TO THE INVENTION

Watch striking mechanisms are high complications, and they are complicated both by the number and the complexity of the cinematics of their components, and according to the modes of operation of which they are capable.

In striking mechanisms, more particularly striking mechanisms having traditional repeaters, the minute snail, that is to say the cam carrying the notch for regulating the minutes striking mechanism which cooperates with the feeler of the minutes piece, is fixed directly to the cannon which carries the minute hand at its extremity. A suchlike arrangement guarantees a mechanism without any offset between the position of the minute hand having regard for the minutes scale of the dial and the number of strokes of the struck minutes.

When it is wished, for aesthetic or other reasons, to offset the disposition of the hour hand and the minute hand axially in relation to the minute snail conventionally carried by the principal cannon pinion, a secondary cannon pinion connected to the principal cannon pinion by means of an intermediate wheel or advantageously by the motion work of the movement is provided. In a suchlike configuration, the correspondence between the position of the minute snail carried by the principal cannon pinion and the position of the minute hand carried by the secondary cannon pinion, with regard to the minutes scale, is dependent on the sum of the angular backlash in the minute train. This total backlash between the secondary cannon pinion and the principal cannon pinion carrying the minute snail is typically in the order of 3 to 8°. Considering that an arc of 6° represents a minute of reading error on the minutes scale of the dial, there are circumstances in which the position of the minute hand with regard to the minutes scale of the dial and the number of strokes of the struck minutes is incorrect. Of course, this situation is unacceptable for the de luxe and high-quality products that constitute timepieces equipped with watch movements having a minute repeater or grande sonnerie striking mechanism.

SUMMARY OF THE INVENTION

The principal aim of the invention is thus to make available a watch movement having a striking mechanism, more particularly a minute repeater, intended to address the disadvantages of the prior art and, in particular, to make available a suchlike movement intended to reduce or suppress the backlash in the train extending between the principal cannon pinion and the secondary cannon pinion in order to ensure a perfect agreement between the position of the minute hand with regard to the minutes scale of the dial and the number of strokes of the struck minutes.

The invention likewise has as its aim to make available a suchlike watch movement which is space-saving, economical and simple to implement.

The invention likewise has as its aim to make available a device that is capable of being regulated by a watchmaker, which regulation makes it possible to compensate for any tolerance errors in the dimensions of the components, which are often significant in these mechanisms that are highly complicated and are manufactured in small series.

For this purpose, the invention relates to a mechanical watch movement comprising a striking mechanism, said striking mechanism including at least a first cannon equipped with a first cannon pinion and on which there is mounted coaxially at least one snail intended to cooperate with a sensor means of the striking mechanism, said first cannon pinion being arranged to be driven at least indirectly by the going train of the movement, said movement being characterized in that it further comprises a second cannon equipped with a second cannon pinion, in that the second cannon pinion carries the minute hand, in that the second cannon pinion is in engagement, on the one hand, with the going train and, on the other hand, with a minute wheel, in that the minute wheel is in engagement with the first cannon pinion, in that a motion-work pinion is in engagement with an hour wheel coaxial with the second cannon pinion, and in that the minute wheel is mounted on a lever arranged to pivot about a fixed point, and of which an angular position may be adjusted by pivoting in such a way as to permit regulation of the position of the minute wheel with respect to the pinion of the first cannon and to the pinion of the second cannon.

Thanks to this device, by its action on the angular position of the lever carrying the minute wheel, the watchmaker has at his disposal a simple device for the adjustment of the backlash in the train extending between the first cannon pinion and the second cannon pinion. In this way, the watchmaker is able to adjust the distance between the staff of the minute wheel and the respective staffs of the first and second cannon pinions easily and, as a result, to regulate the depth of penetration of the teeth of the minute wheel in the toothing of the respective pinions of the first and second cannons, thereby adjusting the backlash in the train and, in so doing, guaranteeing a perfect correspondence between the position of the minute hand having regard for the minutes scale of the dial and the position of the minute snail at the time of gathering information by the feeler of the minutes piece and thus the number of strokes struck.

According to other advantageous features of the invention:

- the adjustment of the angular position of the lever is realized by means of an eccentric member moving in a housing provided at an opposite extremity to the fixed point of the lever.
- the lever is secured in position in its adjusted angular position by friction between the eccentric and the housing of the lever or by a supplementary locking screw close to the eccentric.
- the minute wheel is mounted freely in rotation about an axis which extends perpendicularly to the plane of the movement, and the lever extends in a plane parallel to the plane of the watch movement.

the lever is arranged with respect to the pinion of the first principal cannon and with respect to the pinion of the second cannon in such a way that an angular displacement of the lever results in a penetration of the teeth of the minute wheel to an identical depth in the toothing of the pinion of the first cannon and in the toothing of the pinion of the second cannon.

the teeth of the minute wheel each comprise drive flanks exhibiting a rectilinear segment forming an angle at the vertex comprised between 2 and 10°.

the first cannon comprises a minute snail, a surprise piece and a quarter snail.

the minute wheel is integral with a motion-work pinion coaxial therewith and in that the motion-work pinion is in engagement with an hour wheel.

the hour wheel is coaxial with the second cannon pinion, and the hour wheel exhibits a cannon surrounding the second cannon pinion and of which the extremity carries an hour hand.

in order to further support the backlash adjustment function, the form of the flanks of teeth comprising two rectilinear segments forming an angle at the vertex is arranged so as to favour the linearity of the reduction in play over the range of adjustment.

BRIEF DESCRIPTION OF THE DRAWINGS

Other characterizing features and advantages of the invention will be appreciated from a perusal of the following detailed description, with reference to the accompanying drawings, in which.

DETAILED DESCRIPTION OF PREFERRED EMBODIMENTS

Figure 1:
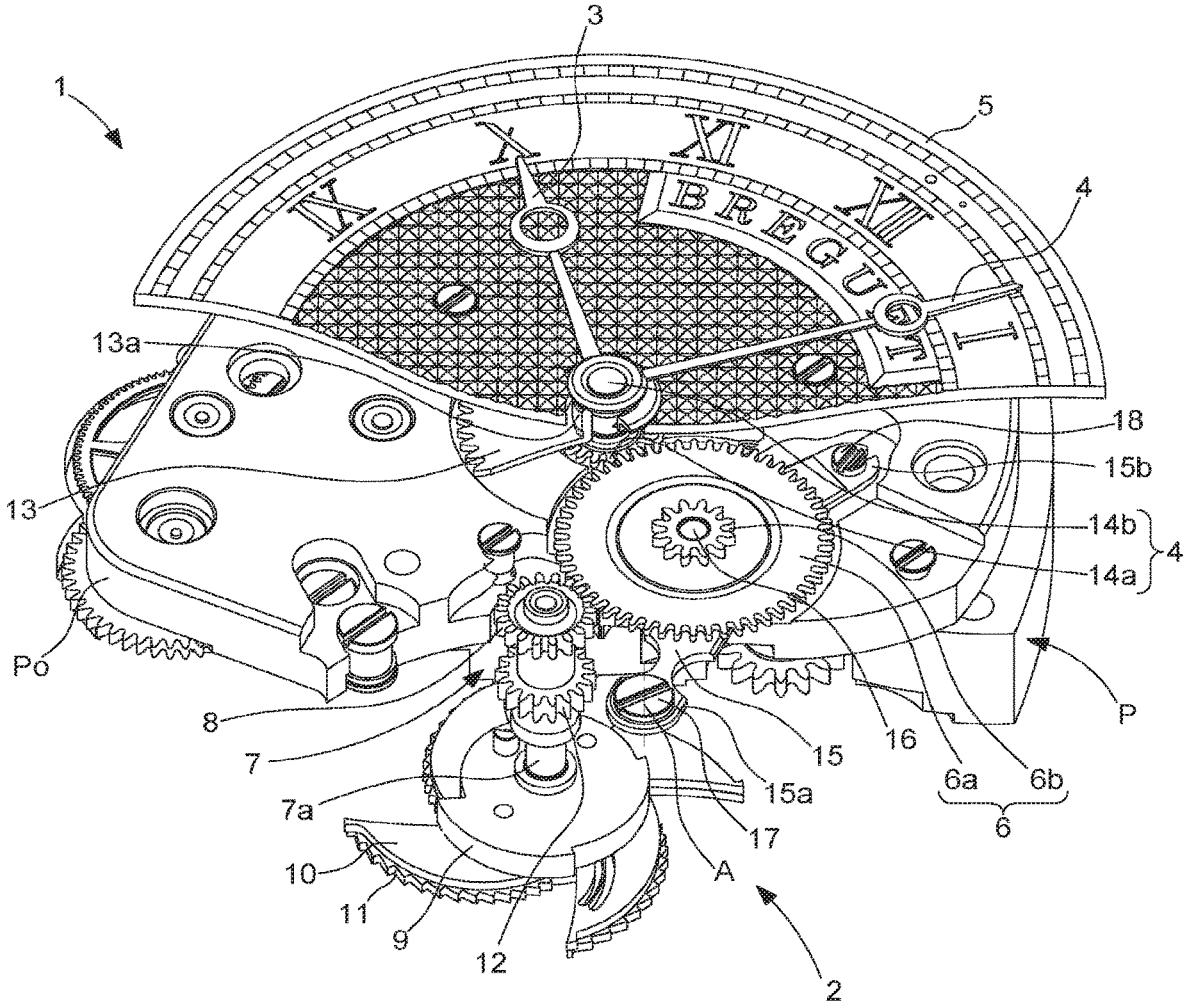
FIG. 1 depicts a partially cut-away perspective view of a watch movement comprising an inventive striking mechanism.
Figure 1A:
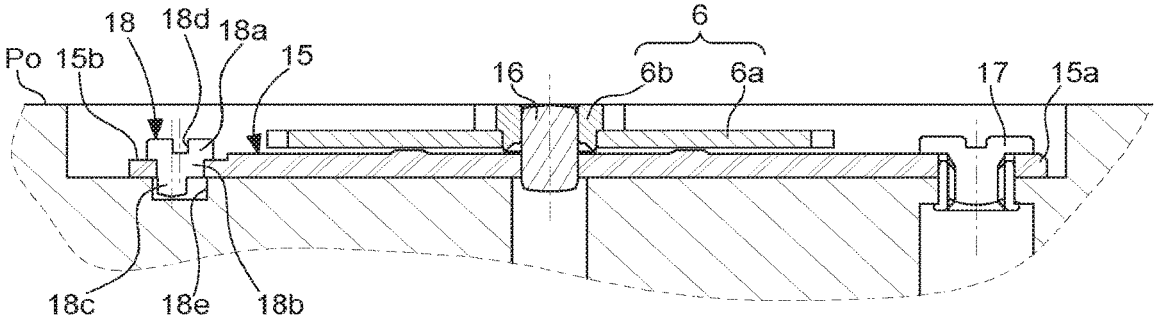
FIG. 1*a* depicts a partial section of the inventive movement showing the lever carrying the motion-work wheel.
Figure 1B:
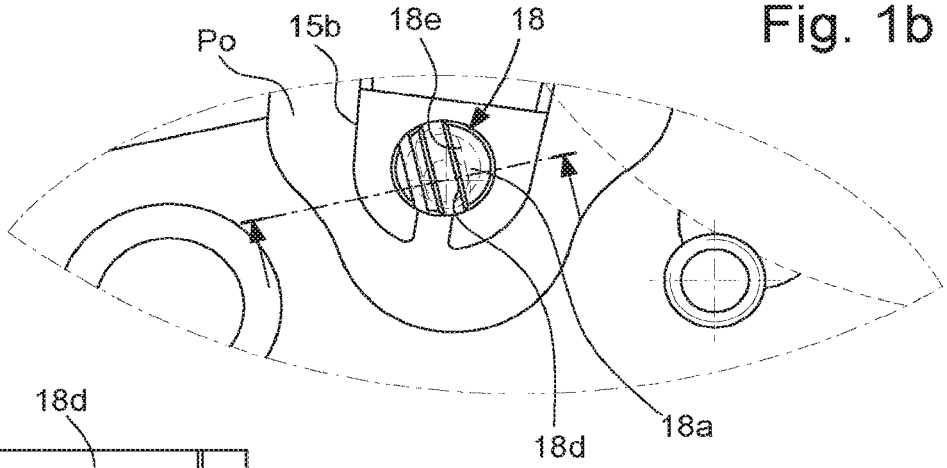
FIG. 1*b* depicts in a view from above a detail of FIG. 1 illustrating the device for regulating the angular orientation of the lever carrying the motion-work wheel.
Figure 1C:
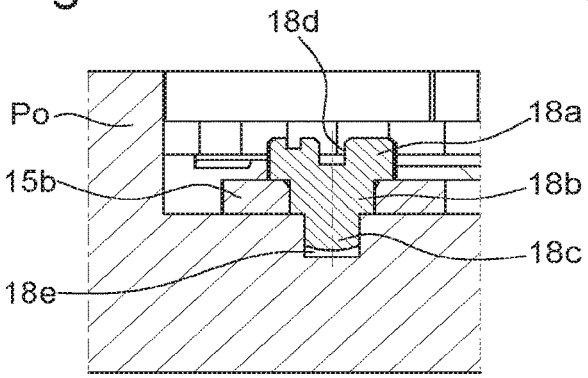
FIG. 1*c* depicts a section along line A-A in FIG. 1*b;*
Figure 2:
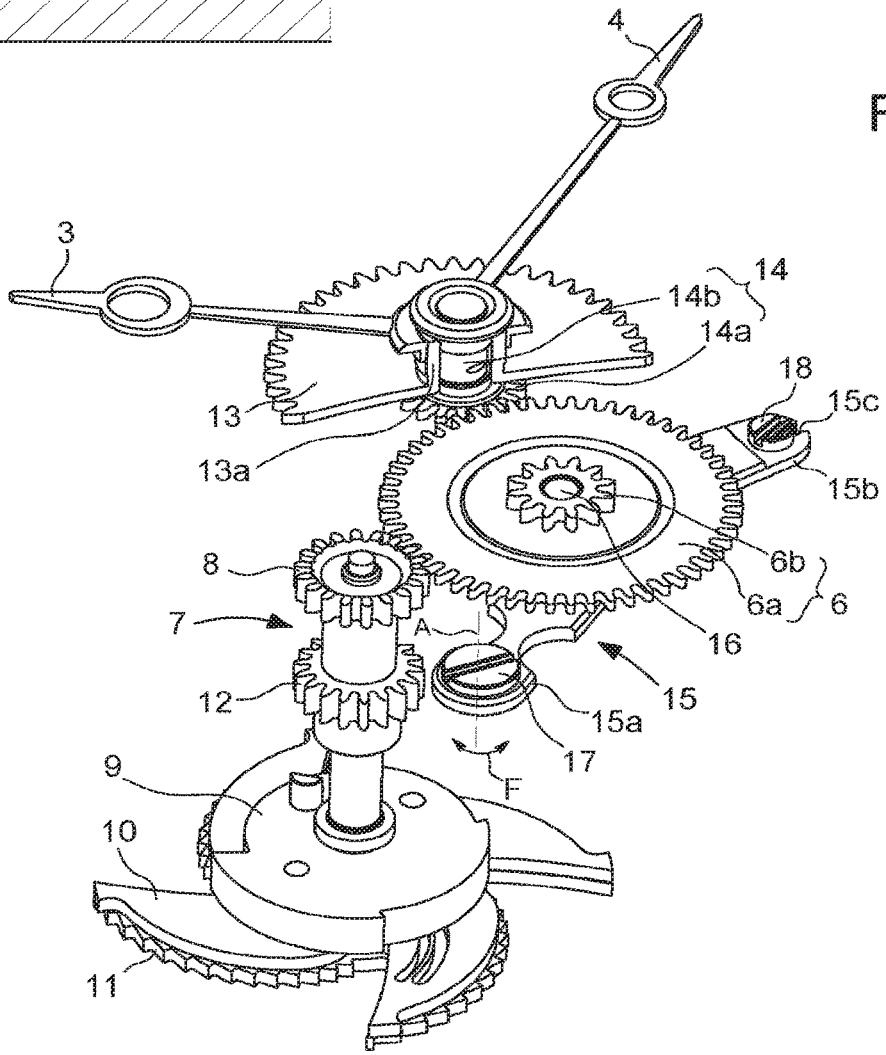
FIG. 2 depicts in perspective a detail of the inventive watch movement illustrated in FIG. 1.

FIG. 1 depicts a watch movement 1 intended to be integrated into a timepiece, for example, of the wristwatch type. The watch movement 1 includes at least a striking mechanism 2, of which only the elements necessary for the comprehension of the invention are depicted.

A person skilled in the art will be able to refer to the work by François LECOULTRE "*Les montres compliquées*", Editions horlogères, Bienne (Switzerland), 1985, ISBN 2-88175-000-1, which explains in a detailed manner the constituent basic mechanisms of the striking mechanisms, on pages 97 to 205, in different chapters:

striking mechanisms,
antique repeater,
modern quartz repeater,
simplified repeater,
half quarter repeater,
Breguet half quarter repeater,
five minute repeater,
minute repeater,
grande sonnerie.

Except where necessary, these basic mechanisms will not be discussed here in detail, and a specialist in striking mechanisms will be able to identify the composition thereof in this universal reference work, in the chapters referred to above, which are incorporated herein by reference.

The movement 1, which is partially depicted in perspective conventionally comprises a plate P, a barrel engaging with a going train in engagement with an escapement (not depicted). The going train is likewise connected to a minute train M, which drives the hour hand 3 and the minute hand 4, which are displaced at the centre of a dial 5 surmounting the movement 1. In this particular case, the movement is circular and the dial is not centred on the movement.

The minute train conventionally comprises a motion-work wheel 6 formed by a minute wheel 6*a* and a motion-work pinion 6*b*.

The striking mechanism 2 includes a first cannon 7 comprising a staff 7*a* carrying at an upper extremity a first cannon pinion 8 in engagement with a minute wheel 6*a*. The staff 7*a* carries successively, likewise coaxially and in a superposed manner, a quarter snail 9, a surprise piece 10 and a minute snail 11 which cooperate respectively with feelers (not depicted) of the striking mechanism 2. Of course, in a variant embodiment of the invention, the staff 7*a* may comprise only one snail. In the illustrated example, the staff 7*a* of the first cannon pinion likewise carries in its middle part a pinion 12 intended to come into engagement with a traditional time-setting mechanism (not depicted). According to one variant, the pinion 12 could be omitted and the time-setting mechanism could come into engagement directly with the motion work M, for example with the minute wheel 6*a*. The motion-work pinion 6*b* is in engagement with an hour wheel 13, of which the cannon 13*a* carries the hour hand 3. The minute wheel 6*a* is likewise in engagement with a pinion 14*a* of a second cannon pinion 4, of which the body 14*b* extends coaxially through the cannon 13*a* and carries the minute hand 4. The pinion 14*a* of the second cannon pinion is in addition in engagement with the going train, as a result ensuring driving of the motion work M, which in this way drives the first cannon 7 indirectly.

As will be appreciated from the figures, the motion-work wheel 6 is mounted in a pivotal manner on a lever 15 about a staff 16 inserted in an opening provided, in the illustrated example, in a middle part of the lever 15. The lever 15, which exhibits a generally arched form, is fixed at a first 15*a* of its extremities by means of a screw 17 screwed directly into a bridge Po extending above the plate P. The lever exhibits in the zone of the first extremity 15*a* a neck defined by a narrowing R forming a flexible part capable of deflecting elastically and defining an axis of flection FL extending perpendicularly to the plane of the lever 15. The lever 15 comprises at its second extremity 15*b* opposite the fixed extremity 15*a* a housing 15*c* in which an eccentric member 18 moves, which comprises a head 18*a* extended by a cylindrical body 18*b* extended in turn by a nipple 18*c* that is eccentric in relation to the cylindrical body 18*b*. The head 18*a* is equipped on its upper face with a slot 18*d* to receive the extremity of an actuating tool. The body 18*b* is inserted into a corresponding opening of the lever 15, and the nipple 18*c* extends into an oblong opening 18*e* provided in the bridge Po. The lever may accordingly be displaced in rotation about its axis of flection FL situated at the narrowest point of the narrowing R in a plane substantially parallel to the plane of movement 1 according to the arrow F when the eccentric member 18 is actuated causing it to rotate. The angular position of the lever 15 may thus be adjusted by the actuation of the eccentric member 18 in rotation, for example by means of a screwdriver, in such a way as to permit the simultaneous regulation of the position of the minute wheel 6*a* with respect to the pinion 8 of the first cannon 7 and to the pinion 14*a* of the second cannon 14. The position of regulation is maintained by the friction of the body 18*b* in the opening of the lever 15. It should be noted in addition that the elasticity of the neck makes it possible, after regulating the position of the lever, to recall the latter and to reduce the backlash in the train by the same amount.

More specifically, the lever 15 is arranged with respect to the pinion 8 of the first cannon 7 and with respect to the pinion 14*a* of the second cannon 14 in such a way that an angular displacement of the lever 15 about the axis of flection FL results in a circular displacement of the lever 15, which results in a penetration of the teeth of the minute wheel 6*a* to an identical depth in the toothing of the pinion 8 of the first cannon 7 and in the toothing of the pinion 14*a* of the second cannon 14.

It should be noted in this regard that a watch gearing typically has, at the nominal centre distance, a toothing backlash in the order of 0.16 times the angular pitch of a toothing.

Let us assume, for example for a pinion having 20 teeth, a backlash of 360°/20×0.16, or 2.68°. For a wheel engaging with two other wheels or pinions, as in the case of the minute wheel of the inventive movement, the backlash is cumulative, which gives a total backlash in the order of 2×2.68°, or 5.36°. With a suchlike backlash and having regard for the manufacturing tolerances of the wheels, it is difficult to guarantee that the position of the minute hand 4 carried by the cannon 14, having regard for the minutes scale of the dial 5 and the number of strokes of the struck minutes given by the minute snail 11 carried by the cannon pinion, is in correspondence. As a result, the inventive movement and more particularly the arrangement of the motion-work wheel 6 on the lever 17, of which the position is adjustable in an angular manner about the axis of flection FL, makes it possible to cause the respective nominal centre distances between the minute wheel and the first 7 and second 14 cannons to vary simultaneously and, more particularly, to reduce these centre distances in order to optimize the backlash between the toothings and to permit meshing with a backlash ensuring, on the one hand, a perfect correspondence between the position of the minutes and the minute hand having regard for the dial and, on the other hand, minimal wear of the toothings at issue.

With reference more specifically to FIGS. 3, 3*a* and 4 and 4*a*, the minute wheel 6*a* is depicted respectively in two positions for the adjustment of the penetration of its toothing into the toothing of the pinions 8 and 14*a* of the first and second cannons 7 and 14.

Figure 3:
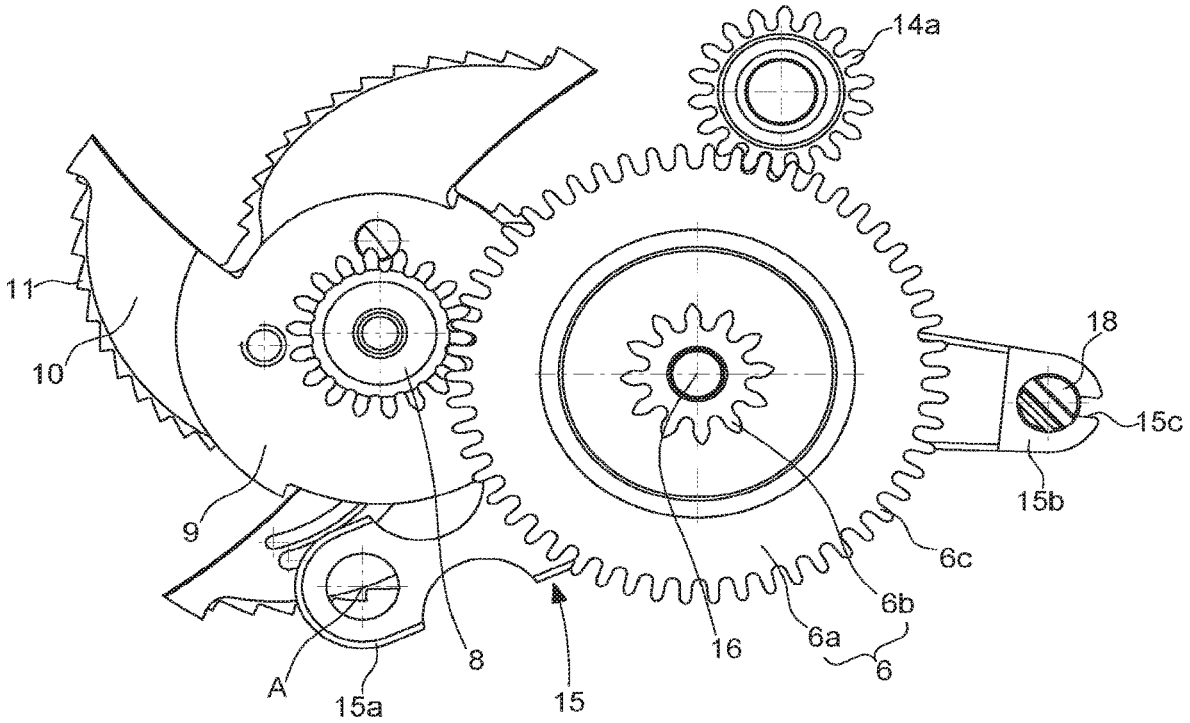
FIGS. 3 and 4 depict respectively in a view from above the minute wheel in two positions for the regulation of the lever carrying the motion-work wheel in order to adjust the depth of penetration of the toothing of the minute wheel in the toothing of the cannon pinions of the inventive movement.
Figure 3A:
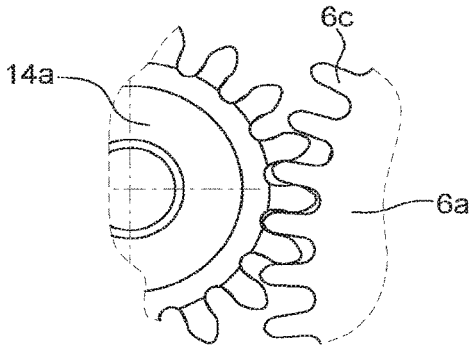
FIGS. 3*a* and 4*a* are respectively views in detail of the engagement of the toothing of the minute wheel in a cannon pinion in FIGS. 3 and 4.

In FIGS. 3 and 3*a*, it can be seen that the nominal centre distance between the minute wheel 6*a* and the pinions 8 and 14*a* of the first 7 and second cannons 14 has been reduced in a manner such that the backlash between the toothings of this wheel and these pinions is essentially zero. A suchlike configuration is not optimal, more particularly in terms of wear, even if it ensures a perfect correspondence between the position of the minutes and the minute hand having regard for the dial.

Figure 4:
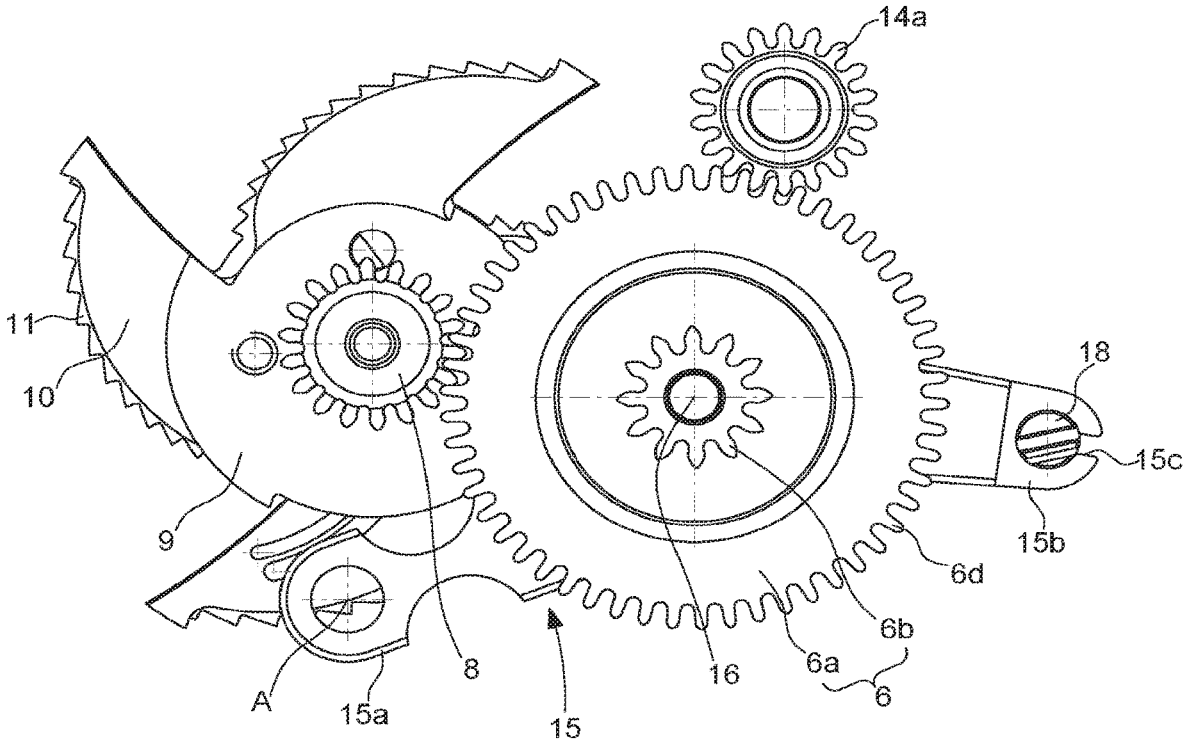
Figure 4A:
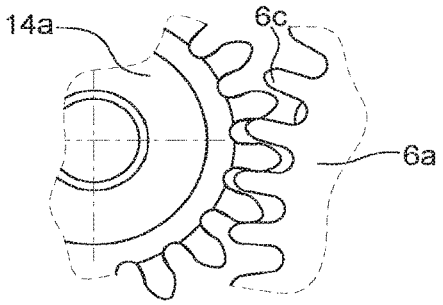
Figure 5:
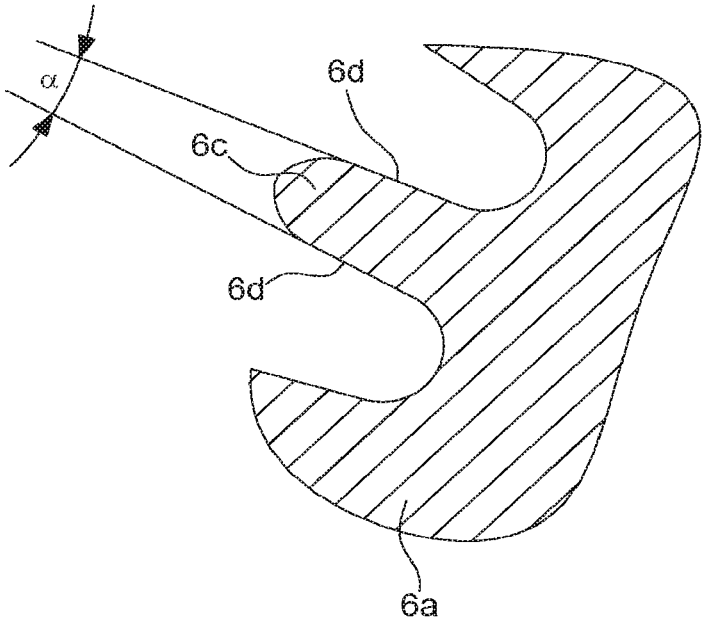
FIG. 5 is a detail of the toothing of the minute wheel.

In FIGS. 4 and 4*a*, in contrast, the nominal centre distance between the minute wheel 6*a* and the pinions 8 and 14*a* of the first 7 and second cannons 14 has been reduced to a lesser extent compared to FIGS. 3 and 3*a*, in a manner such that the backlash between the toothings of this wheel and these pinions is comprised between 2° and 4°. This ensures minimal wear of the toothings and guarantees a perfect correspondence between the position of the minutes and the minute hand having regard for the dial.

Advantageously, the toothing of the minute wheel which contains the largest number of teeth may exhibit teeth 6*c* which each comprise drive flanks 6*d* having a rectilinear segment forming an angle at the vertex comprised between 2 and 10° in order to facilitate the penetration of this toothing into that of the wheels and pinions with which it engages when the nominal centre distance is reduced by the pivoting of the lever 15 at the moment of the adjustment of the position of the motion-work wheel 6.

The invention claimed is:

1. A mechanical watch movement comprising:

a striking mechanism, said striking mechanism including at least a first cannon equipped with a first cannon pinion, and on which there is mounted coaxially at least one snail intended to cooperate with a sensor means of the striking mechanism, said first cannon being arranged to be driven at least indirectly by the going train of the movement; and a second cannon equipped with a second cannon pinion, the second cannon pinion carries a minute hand, the first cannon is in engagement with the going train, and with a minute wheel, the minute wheel is in engagement with the first cannon pinion, a motion-work pinion is in engagement with an hour wheel coaxial with the second cannon and the minute wheel is mounted on a lever arranged to pivot about a fixed point, and of which an angular position may be adjusted by pivoting in such a way as to permit regulation of the position of the minute wheel with respect to the pinion of the first cannon pinion and to the second cannon pinion.

2. The mechanical watch movement according to claim 1, wherein the adjustment of the angular position of the lever is realized with an eccentric member moving in a housing provided at an opposite extremity to the fixed point of the lever.

3. The mechanical watch movement according to claim 2, wherein the lever is secured in position in its adjusted angular position by friction between the eccentric and the housing of the lever.

4. The mechanical watch movement according to claim 1, wherein the minute wheel is mounted freely in rotation about an axis which extends perpendicularly in a plane parallel to the plane of the movement, and wherein the lever extends parallel to the plane of the watch movement.

5. The mechanical watch movement according to claim 1, wherein the lever is arranged with respect to the first cannon pinion and with respect to the second cannon pinion in such a way that an angular displacement of the lever results in a penetration of the teeth of the minute wheel to an identical depth in the toothing of the first cannon pinion and in the toothing of the second cannon pinion.

6. The mechanical watch movement according to claim 1, wherein the teeth of the minute wheel each comprise drive flanks exhibiting a rectilinear segment forming an angle at the vertex comprised between 2 and 10°.

7. The mechanical watch movement according to claim 1, wherein the first cannon comprises a minute snail, a surprise piece and a quarter snail.

8. The mechanical watch movement according to claim 1, wherein the minute wheel is integral with a motion-work pinion coaxial thereto, and in that the motion-work pinion is in engagement with an hour wheel.

9. The mechanical watch movement according to claim 8, wherein the hour wheel is coaxial with the second cannon, and wherein the hour wheel exhibits a cannon surrounding the second cannon pinion, and of which the extremity carries an hour hand.

10. A timepiece, comprising:

a movement comprising a striking mechanism, said striking mechanism including at least a first cannon equipped with a first cannon pinion, and on which there is mounted coaxially at least one snail intended to cooperate with a sensor means of the striking mechanism, said first cannon being arranged to be driven at least indirectly by the going train of the movement; and a second cannon equipped with a second cannon pinion, the second cannon pinion carries a minute hand, the first cannon is in engagement with the going train, and with a minute wheel, the minute wheel is in engagement with the first cannon pinion, a motion-work pinion is in engagement with an hour wheel coaxial with the second cannon and the minute wheel is mounted on a lever arranged to pivot about a fixed point, and of which an angular position may be adjusted by pivoting in such a way as to permit regulation of the position of the minute wheel with respect to the pinion of the first cannon pinion and to the second cannon pinion.

11. The timepiece according to claim 10, wherein the timepiece is a wristwatch.

* * * * *